United States Patent [19]

Hubbard

[11] 4,120,127

[45] Oct. 17, 1978

[54] DOUBLE GLAZED WALL STRUCTURE

[75] Inventor: S. Eugene Hubbard, Niles, Mich.

[73] Assignee: Kawneer Company, Inc., Niles, Mich.

[21] Appl. No.: 783,802

[22] Filed: Apr. 1, 1977

[51] Int. Cl.[2] ..... E06B 7/12; E06B 3/28

[52] U.S. Cl. ..... 52/172; 52/202; 52/398

[58] Field of Search ..... 52/172, 171, 203, 202, 52/616, 398, 399, 741, 397

[56] References Cited

U.S. PATENT DOCUMENTS

| | | | |
|---|---|---|---|
| 3,012,642 | 12/1961 | Emmerich | 52/399 X |
| 3,055,468 | 9/1962 | Horejs | 52/398 |
| 3,064,320 | 11/1962 | Blaszkowski | 52/398 |
| 3,971,178 | 7/1976 | Mazzoni | 52/172 |

FOREIGN PATENT DOCUMENTS

| | | | |
|---|---|---|---|
| 2,420,870 | 11/1975 | Fed. Rep. of Germany | 52/203 |
| 580,743 | 10/1976 | Switzerland | 52/616 |
| 1,166,474 | 10/1969 | United Kingdom | 52/616 |

*Primary Examiner*—John E. Murtagh
*Attorney, Agent, or Firm*—Mason, Kolehmainen, Rathburn & Wyss

[57] ABSTRACT

Method and apparatus for converting a single glazed wall structure into a double glazed wall structure. The apparatus comprises a spacer element supportable from the wall structure frame on one side of the existing glazing panel and the element includes a stop surface parallel and facing an edge portion of a second glazing panel to be installed parallel of the first glazing panel. A seal is provided around an edge portion of the second glazing panel in position adjacent the spacing element thereby forming a dead air space between the first and second glazing panels to provide a double glazed wall structure having much improved heat insulating characteristics in comparison to the pre-existing single glazed wall structure.

In accordance with the method of the invention, a spacer element is positioned on one side of the existing glazing panel around the frame and a second glazing panel is then installed in spaced parallel relation with the existing panel adjacent the spacer element. A seal is formed between the first and second glazing panels to provide a sealed air space therebetween with a resulting wall structure having excellent heat insulating characteristics.

38 Claims, 13 Drawing Figures

FIG. 1
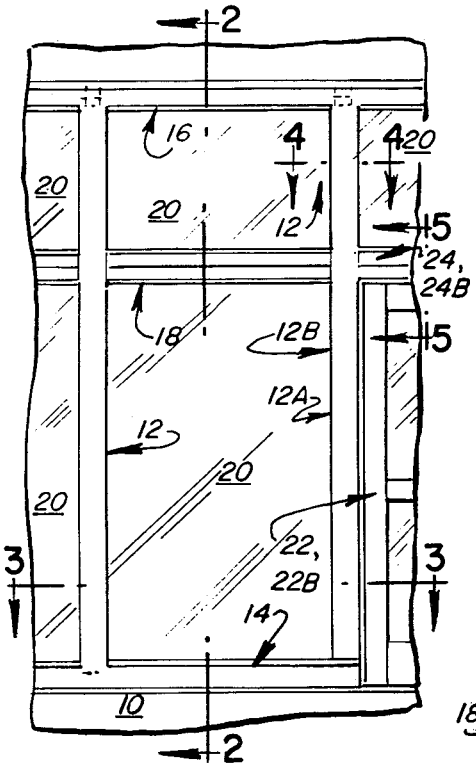
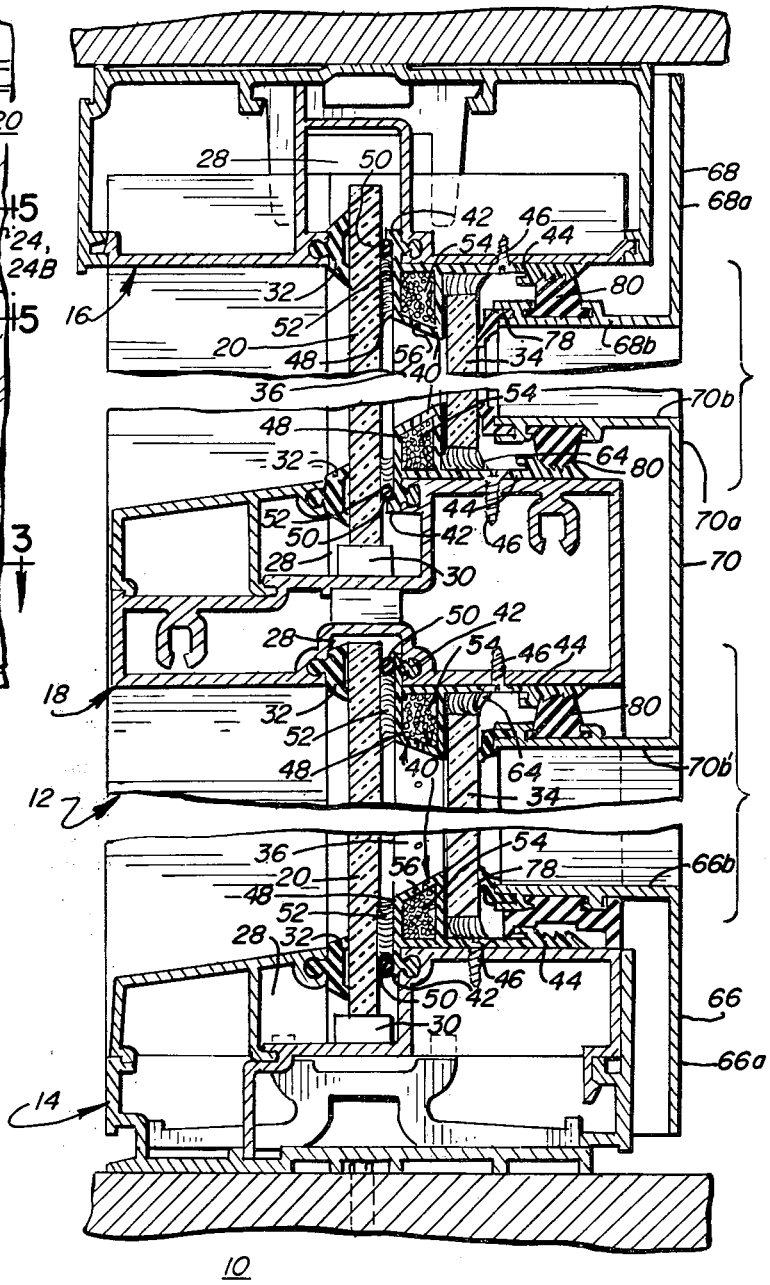
FIG. 2
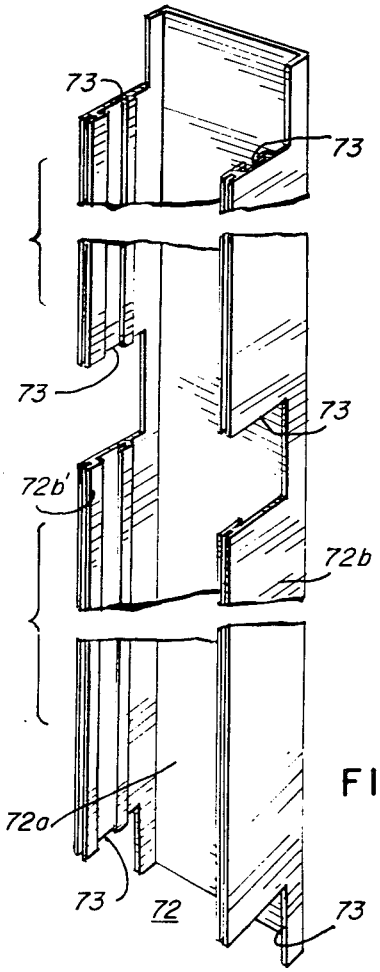
FIG. 9

DOUBLE GLAZED WALL STRUCTURE

BACKGROUND OF THE INVENTION

1. Field of the Invention

The present invention relates to a new and improved glazed wall structure of the type employing a structural framing system comprising vertical and horizontal framing members for supporting one or more glazing panels or other types of panels in a curtain wall type structure of a building. More particularly, the present invention relates to a new and improved method and apparatus for converting an existing single glazed building wall structure of the general type described into a double glazed system having vastly improved heat insulating characteristics. The present invention provides a system wherein a typical single glazed curtain wall structure, for example, a structure like that shown in U.S. Pat. No. 3,961,452, may be rapidly and efficiently converted into a double glazed wall structure having greatly improved heat insulating characteristics and conversion may be accomplished without requiring removal of the existing glass panels and without requiring the removal or dismanteling of the existing frame system supporting the glazing panels. Moreover, the present invention provides an efficient and economic way of converting an existing single glazed wall structure into a double glazed wall without appreciably affecting the architectural lines or esthetics of the existing glazing system. The dual glazed wall is achieved without requiring the opening of the building wall to weather and the like and with a minimum of disruption for the occupants in the building while the conversion is taking place.

It is therefore an object of the present invention to provide a new and improved method and apparatus for converting a single glazed wall structure of a building wall into a double glazed wall structure having greatly improved heat insulating characteristics.

Another object of the invention is to provide a new and improved method of the character described which can be accomplished with a minimum disturbance of the existing building structure and with a minimal disruption of the normal activities of persons occupying the building during the conversion process.

Still another object of the present invention is to provide a new and improved apparatus for converting a single glazed wall structure of a building into a double glazed insulating wall structure having greatly improved heat insulating characteristics.

Another object of the present invention is to provide a new and improved apparatus of the character described which not only improves the insulating characteristics of the pre-existing glass or glazing panels themselves, but in addition, a system which improves the insulating characteristics of the frame system which supports the glazing panels.

Still another object of the present invention is to provide a new and improved apparatus of the character described which provides a building wall structure with much higher heat insulating characteristics in comparison to those of the pre-existing single glazed building wall structure before conversion thereof.

Another object of the present invention is to provide a new and improved method and apparatus for converting an existing single glazed wall structure into a double glazed wall structure of the character described whereby serious or unsightly detractions from the architectural esthetics of the building, or limitations in vision area or available sunlight through the wall are not required.

Another object of the present invention is to provide a new and improved system which does not require the removal of existing glazing panels.

Yet another object of the present invention is to provide a new and improved system which permits the conversion from a single to dual glazed wall to be accomplished from within or on the inside walls of the building, thus eliminating the need for external scaffolding and the like.

Yet another object of the present invention is to provide a new and improved system for converting a single glazed wall structure into a double glazed structure of the character described which provides a sealed off dead air space between the existing glazing and the newly installed second glazing panels.

Still another object of the present invention is to provide a new and improved method and apparatus for improving the heat insulating characteristics of a glazed wall system by the addition of one or more glazing panels in parallel with and without requiring removal of the existing glazing panel.

Yet another object of the present invention is to provide a new and improved method and apparatus of the character described in the foregoing object wherein additional dual glazing panels are positioned in parallel with an existing glazing panel adjacent either the inside or outside face thereof.

Still another object of the present invention is to provide a new and improved method and apparatus in accordance with the foregoing object wherein additional single or dual glazing panels are positioned adjacent and parallel either side of an existing single or dual glazing panel to provide a multiple glazed wall system.

Still another object of the invention is to provide a new and improved apparatus of the character described which provides a desiccant material in communication with the dead air space between the existing and newly installed glazing panels so that moisture is absorbed to prevent condensation of moisture on the glass.

Another object of the invention is to provide a new and improved method and apparatus for converting a single glazed wall structure into a dual glazed system on an economical basis and in a manner which requires a minimal amount of time for the conversion to be completed.

2. Description of the Prior Art

In many typical prior art wall structures of the type employing a double glazed glass panel such as THERMOPANE TM or TWINDOW TM, the glazing panels are thick and costly and special framework is required to accommodate the thick dual glazed units. In existing single glazing wall systems, the framework is not usually capable of accepting the thicker, dual glazed panel without extensive and costly modification. Accordingly, when it is desired to reduce the heat loss through a single glazed wall structure in an existing building structure by the installation of THERMOPANE TM panels, it is necessary to remove the pre-existing single glazed panels and in addition, the pre-existing framework itself must be modified to receive the new panels. Thus, an entirely new wall structure system is generally required and this sometimes is not economical. In U.S. Pat. No. 3,573,149 a system is provided wherein an additional glazing panel is added to an existing glazing panel with a curable rubber sealing strip positioned between the panels.

The overall appearance of any new structure required to accommodate new double glazing in a modified single glazed system is often less pleasing and results in a reduced amount of visibility and a diminution of light entering the building because of the bulk of additional framework which is normally attached to the existing frame system. The present invention, however, eliminates these difficulties and the foregoing objects and advantages of the present invention are accomplished as described briefly in the following summary of the invention.

SUMMARY OF THE INVENTION

Apparatus in accordance with the present invention comprises a spacer element supportable from the frame which holds the pre-existing glazing panel. The spacing element includes a stop surface parallel of the pre-existing glazing panel with an edge portion facing a new, second glazing panel installed in parallel spaced apart relation to the existing panel preferably on the inside thereof. Sealing strips are applied between the existing glazing panel and a parallel stop surface of the spacer element and between an adjacent surface of the second glazing panel and a facing portion of the spacer element in order to provide a sealed off or dead air space between the existing and the newly installed second glazing panel.

In accordance with the method of the invention, spacer elements are attached in place on one side along the periphery of the pre-existing glazing panel adjacent the frame and a seal is formed between the spacer elements and the existing glazing panel and between the spacer elements at the panel corners where the spacer elements intersect.

The second glazing panel is then installed in parallel and in spaced apart relation to the existing glazing panel facing the spacer element. A seal is then formed between the spacer element and the second glazing panel around the frame whereby a sealed off dead air space is created between the parallel panels. A desiccant material is provided within cavities in the spacer element in communication with the dead air space to absorb moisture in the air and thus eliminate the condensation moisture on the inside facing surfaces of parallel glazing panels.

BRIEF DESCRIPTION OF THE DRAWINGS

For a better understanding of the present invention reference should be had to the following detailed description taken in conjunction with the drawings in which:

FIG. 1 is an elevational view of a typical wall structure which has been converted into a double glazed wall system in accordance with the principles and the features of the present invention;

FIG. 2 is a vertical cross-sectional view taken substantially along lines 2—2 of FIG. 1;

FIG. 9 is a perspective view of a mullion cover constructed in accordance with the features of the present invention;

DESCRIPTION OF THE PREFERRED EMBODIMENTS

Figure 4:
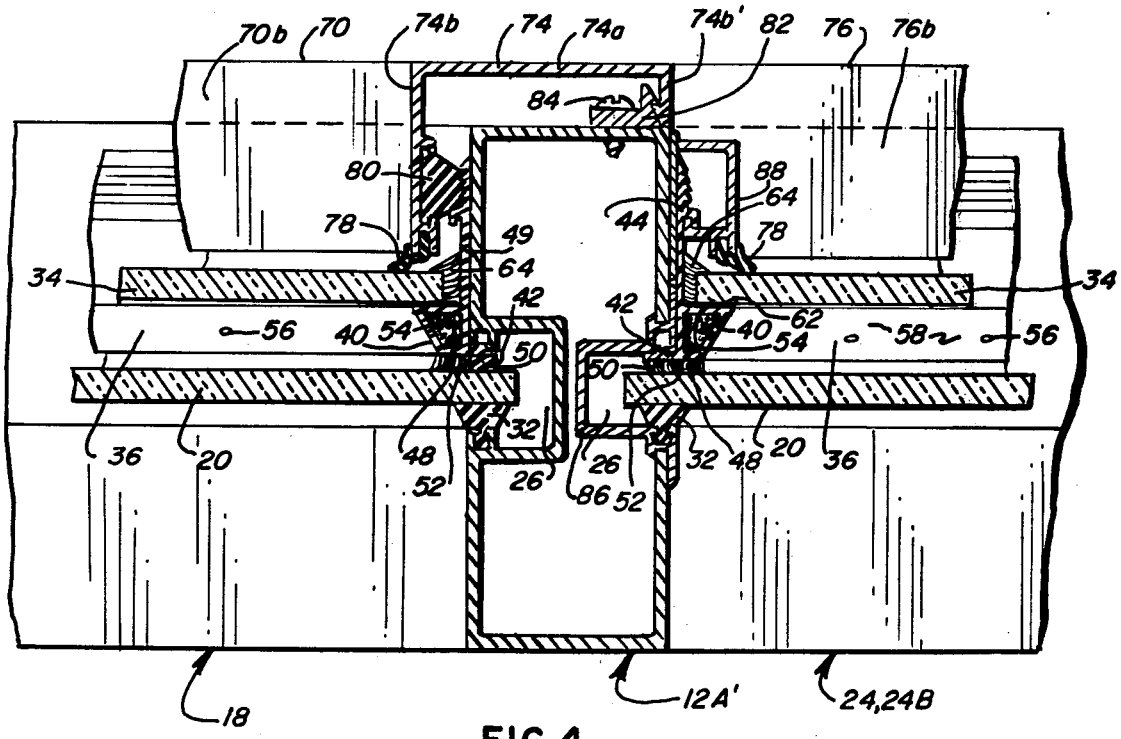
FIG. 4 is a horizontal cross-sectional view taken substantially along lines 4—4 of FIG. 1.
Figure 5:
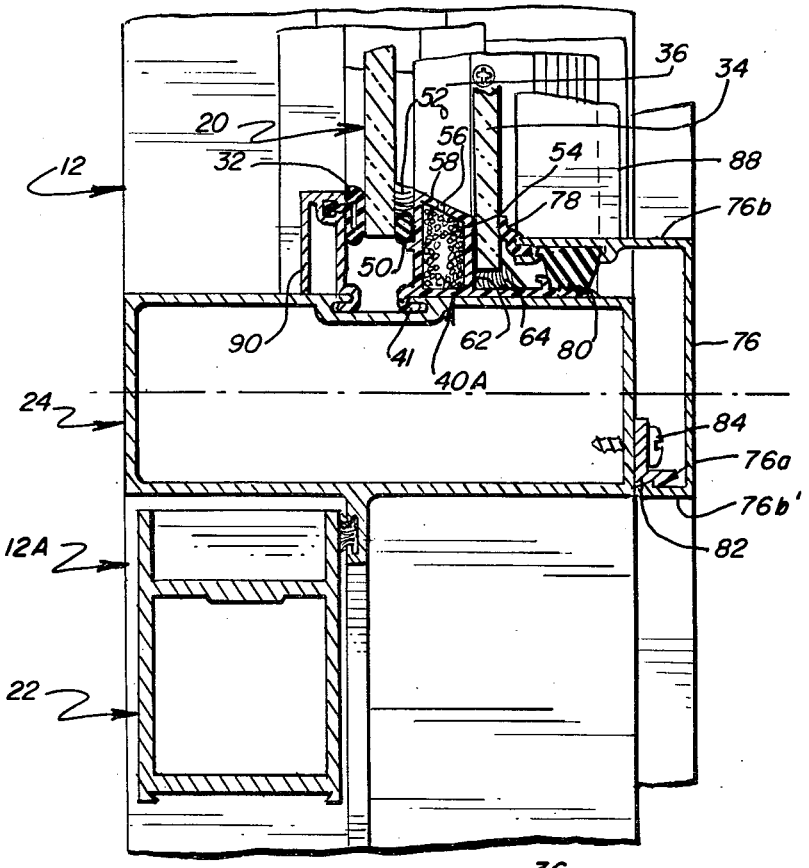
FIG. 5 is a fragmentary vertical cross-sectional view taken substantially along lines 5—5 of FIG. 1.
Figure 6:
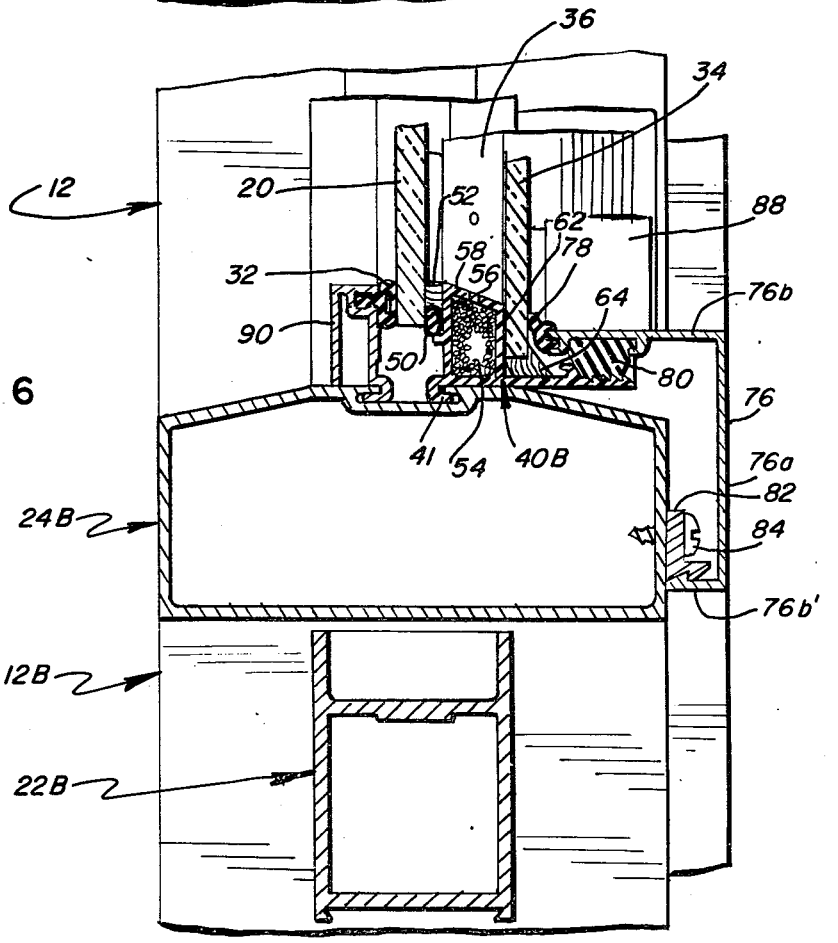
FIG. 6 is a fragmentary vertical cross-sectional view similar to FIG. 5, but illustrating a wall system with a door swingable in both directions.

Referring now more particularly to the drawings and the embodiment illustrated in FIGS. 1 through 6 thereof, the present invention comprises a new and improved method and apparatus for converting a pre-existing single glazed wall structure of the type, for example, illustrated and described in U.S. Pat. No. 3,961,452, which patent is incorporated herein by reference and which patent is assigned to the same assignee as the present application. A single glazed pre-existing wall structure is referred to generally by the reference numeral 10 in FIGS. 1 and 2, and includes a frame comprising one or more vertical mullions 12 interconnected at their lower ends by a sill structure 14 and at their upper ends by a head structure 16. One or more intermediate horizontal members 18 may be provided in the frame which supports a plurality of single thickness glazing panels 20 or the like. The wall structure may also typically contain a door 22 supported on the frame to swing outwardly and a modified door jamb mullion 12A (FIGS. 3 and 5) and a transom section 24 is provided as a frame around the door opening as shown. Referring momentarily to FIG. 6, the wall structure 10 may also include a door 22B which is mounted on a frame to swing both ways and accordingly includes a door frame having a modified form of vertical door jamb 12B and a horizontal transom section 24B. The doors 22 and 22B may be of the type shown and described in U.S. Pat. No. 3,888,046 which patent is incorporated by reference and also which patent is assigned to the same assignee as the present application.

Figure 3:
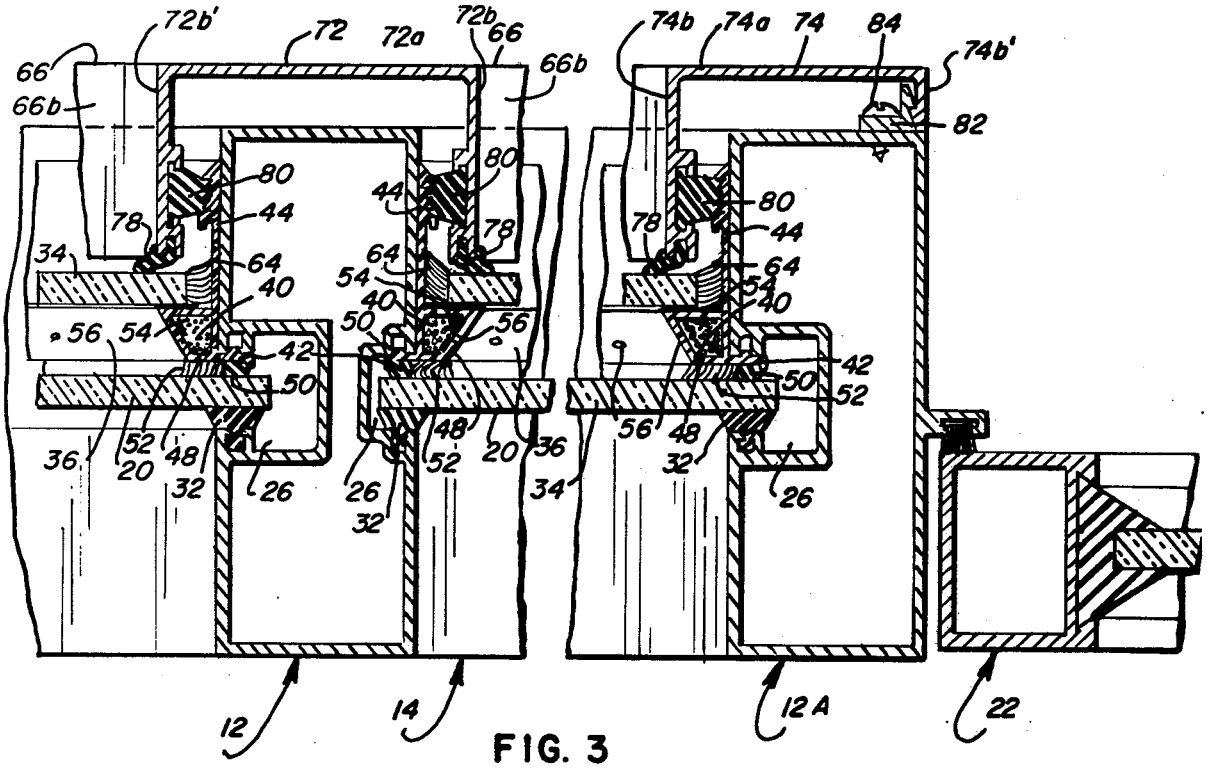
FIG. 3 is a horizontal cross-sectional view taken substantially along lines 3—3 of FIG. 1.

The vertical mullions 12, 12A and 12B of the existing wall structure 10 are formed with glazing pockets or channels 26 for receiving vertical edge portions of the glazing panels 20 as best shown in FIGS. 3 and 4, and similarly, the horizontal sill assemblies 14, head assemblies 16 and the intermediate horizontal assemblies 18 are formed with glazing pockets or channels 28 for receiving horizontal edge portions of the glazing panels. The glazing panels rest on glazing blocks 30 and exterior sealing gaskets 32 are provided for a weather seal between the frame members and the outside surface of the glazing panels.

In accordance with the present invention, the pre-existing wall structure 10 is provided with a plurality of secondary, inside glazing panels 34 positioned in spaced apart parallel relation with existing panels 20 as illustrated and a dead air space 36 is formed between the adjacent facing surfaces of the glazing panels to provide greatly improved heat insulating characteristics. The secondary or inside glazing panels 34 may be installed from inside the building without requiring removal or substantial disturbance of the positioning of the existing glazing panels 20. Prior to installation of the secondary inside panels 34, the existing inside sealant strips between the inside surface of the glazing panels 20 and the frame members of the wall structure 10 (as shown in the aforementioned U.S. Pat. No. 3,961,452) are removed. In the space thus left open between the inside wall surface of the glazing pockets or channels 26 and 28 and the glazing panel edges, a flange or tongue 42 of a new and improved elongated hollow spacer element is inserted and the spacer element is interlocked in place. The tongue 42 of the spacer element includes a ridge interlocked in the groove on the wall of the glazing pocket of the frame member that was formerly occupied by a portion of the removed sealing strip and this interlocking arrangement secures the spacer element 40 in place against the framework of the existing wall structure 10. The spacer elements are cut to length to fit the openings in the framework. The spacers include a flange portion 44 bearing against the adjacent surface of the wall structure frame member perpendicular to the tongue 42 parallel of the glazing panels and sheet metal screws or other suitable fasteners 46 are provided to secure the spacer element more firmly in place.

Air tight sealing is provided between the inside surface of the existing glazing panels 20 and a facing outer wall surface 48 of the spacers 40 by a peripheral elastomeric spacer 50 and elastic caulking material 52 is extruded into place against the spacer as shown by a conventional caulking gun. When the spacer 50 is inserted in place, it causes a small rib on the tongue 42 of the spacer element 40 to fit into the adjacent gasket groove of the frame members and also prevents the loss of caulking compound into the frame cavity around the edge of the glazing panel. After the pre-existing inside sealant strips are removed from the inside surface of the glazing panels 20 and subsequently after the new spacers 40 are cut to length, and installed in place as shown, with caulking and sealing applied as described, the panels 20 are again positively secured in place and this whole procedure can be rapidly accomplished from inside the building structure with minimal disturbance or disruption of the building occupants in the immediate vicinity. As indicated, the spacer elements 40 include a hollow, tubular main body portion which is adapted to contain a quantity of moisture absorbing desiccant material 54 usually in the form of crystals. The desiccant material is in direct communication with the dead air space 36 between the glazing panels 20 and 34 by means of a plurality of spaced apart openings 56 formed in a wall 58 of the spacer extending between the wall 48 adjacent the panels 20 and an inside wall 60 parallel thereto. Before the secondary inside glazing panels 34 are installed in place as shown, an adhesive tape strip 62 having adhesive material on opposite sides are applied against the inward facing surfaces of the wall 60 of the spacer elements. The secondary glazing panels 34 are then installed in place against the adhesive tape 62 and this tape provides a means for temporarily holding the secondary glazing panels in place until a caulking material 64 is applied to firmly secure the panels and positively seal off and close the dead air space 36. After the dead air space 36 is sealed off as described, the desiccant material 54 within the spacer elements 40 is in direct communication with the air in the dead air space and any moisture present is absorbed. Should leakage of moisture into the space subsequently occur, the desiccant material is always available to collect the excess water and fogging of the panels is eliminated. After the secondary glazing panels 34 are installed in place as described and the plastic sealant material 64 is extruded into place as shown, the periphery of each glazing panel is firmly held in place within the wall framework by the peripheral seal.

In accordance with the present invention, after the secondary inside glazing panels 34 have been installed and sealed as described, the horizontal members 14, 16 and 18 of the wall structure and the vertical members 12, 12A and 12B thereof, are enclosed with cover elements especially designed to provide additional heat insulating value for the framework and these elements also cover up the marginal edge portions around the perimeter of the secondary glazing panels 34. In addition, the cover elements provide additional structural retention for the new glazing panels.

Figure 7:
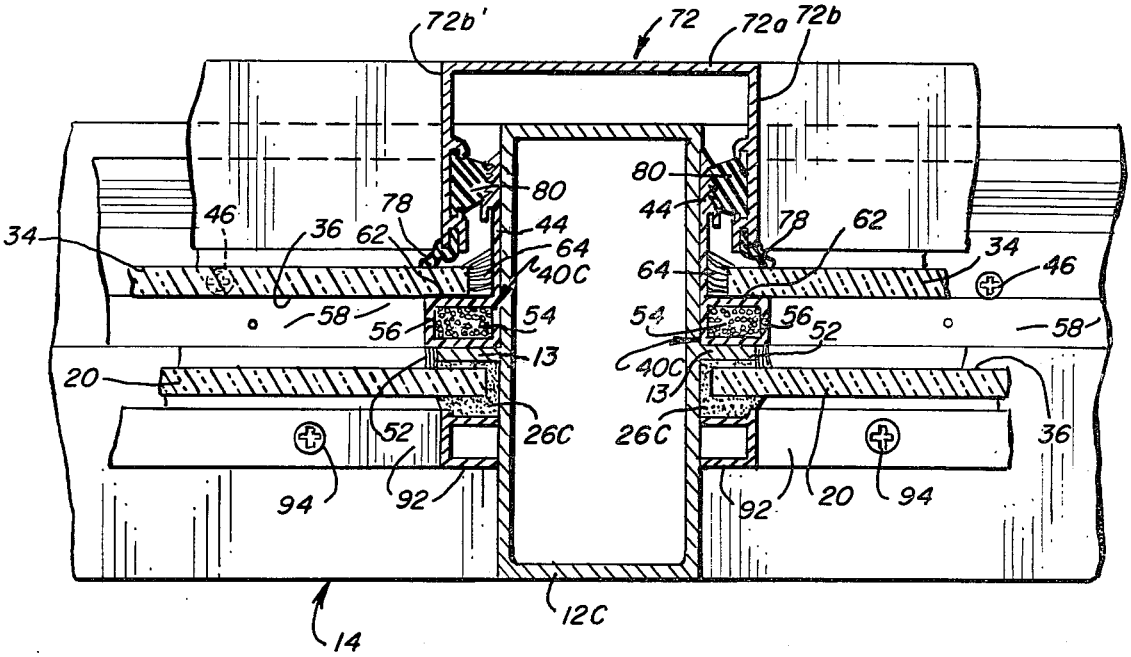
FIG. 7 is a fragmentary horizontal cross-sectional view of another type of vertical mullion employing a tubular body with integral fins on opposite sides.

Referring to FIG. 2, the sill assembly 14 and the head assembly 16 are provided with enclosing cover elements 66 and 68 respectively, of generally angular shape in cross-section as shown. These cover elements include vertical inside flanges **66*a* and 68*a* respectively, and horizontal flanges 66*b* and 68*b* respectively. The intermediate horizontal structural members 18 are provided with cover elements 70 of a generally U-shaped or channel shaped cross-section having a vertically disposed inside web 70*d* and a pair of spaced apart horizontal flanges 70*b* and 70*b*' as shown. Referring to FIGS. 3, 7 and 9, the vertical mullions 12 and 12C are provided with elongated cover elements 72 of generally channel shaped or U-shaped cross-section having inside web portions 72*a* and parallel side flange portions 72*b* and 72*b*' perpendicular to the glazing panels. The mullions 12A and 12 of FIGS. 3 and 4, are provided with cover elements 74 of a modified channel shaped cross-section including a web portion 74*a*, a relatively deep flange portion 74*b* perpendicular thereto and a relatively short or narrow flange 74*b*' as shown. The door transom bars 24 and 24B of FIGS. 5 and 6 are also provided with a cover element 76 of channel shaped cross-section having a vertically disposed side web or faces 76*a*, a deep flange 76*b* perpendicular thereto along one edge and a relatively short flange 76*b*'** as illustrated.

The flanges and webs of the respective cover elements are adapted to be positioned in spaced apart insulating relation parallel to the adjacent wall portions of the frame members of the wall structure 10. Dead air space is provided between the covers and frame members for improving the heat insulating characteristics as well as for covering the marginal edge portions of the inside glazing panels 34 in a way providing an appearance pleasing to the eye. The flange portions **66*b*, 68*b***, 70b, 70b', 72b, 72b', 74b and 76b of the respective cover elements are formed with a groove along the free edge thereof in order to accommodate flexible filler strip 78 which bears against the inside surface of the secondary glazing panels 34 as shown. The flexible filler strip acts as a filler for covering any space between the free edge of the flanges and the inside surface of the inside glazing panels to provide a neat looking finished appearance and additionally, the strips provide thermal insulation between the inside surface of the glazing panels and the cover elements.

The cover elements 66, 68, 70, 72, 74 and 76 are secured in place and are insulated from the respective frame members of the wall structure 10 by means of insulating spacer strips 80 which are keyed into an integral groove on the inside surface of the flanges as shown. The spacer strips are formed of rigid insulating material and include a series of saw-tooth profiled ridges on the outer face thereof adapted to interfit and interlock with similarly shaped ridges provided on the flange portion 44 of the spacer elements 40. Interlocking attachment between the saw-tooth-like ridges of the insulating spacers 80 and the ridges on the flanges of the spacer elements 40 permit the cover elements to snap into place over the frame members. In the case of the angularly cross-sectioned cover elements 66 and 68, the filler strip 78 provides a holding means for securing these cover members in place on the framework. The U-shaped cover elements 72 are secured in place by the action of the opposite flanges 72b and 72b' acting through the insulating spacers 80 to engage the serrated or saw-tooth-like ridges on the flanges 44 of the adjacent spacer elements 40. The cover elements 74 and 76 are also interlocked in place by means of a wedge shaped ridge formed on the inside surface of the short flanges 74b' and 76b', which ridge interlocks with a clip 82 of angle shaped cross-section secured to the frame members by screw fasteners 84.

As shown in FIG. 9, the vertically extending mullion cover elements 72 are field cut to provide slots 73 in flanges 72b and 72b' as illustrated in order to accommodate the horizontal frame members 14, 16 and 18. The horizontal cover elements 66, 68, 70 and 76 are cut to length to butt fit against the respective side flanges 72b and 72b' of the vertical cover elements 72 on the mullions.

From the foregoing it will be seen that the cover elements provide a neat appearance and for the double glazing system add very little to the bulk of the framework of the wall structure 10. In addition, the cover elements improve the heat insulation characteristics of the framework and the rigid insulating spacers 80 between the cover elements and the flanges 44 of the spacer element 40 provide a positive mechanical interlock.

Referring to FIG. 4, the mullion 12A' which extends above the transom bar 24 or 24B is modified somewhat from the mullion 12A which serves as door jambs for the door 22 (as shown in FIG. 3). The mullion 12A' includes an opening in the jamb surface facing the space above the door transom and a separate channel member 86 is inserted in the slot or opening to form a glazing pocket for the existing glazing panels 20 above the transom bar. A separate channel shaped glass stop 88 is provided to interlock with the spacer element 40 as shown to cover the marginal edge portion of the secondary glazing panels 34 after they are installed.

Referring now to FIG. 5, the transom bar 24 is of rectangular, tubular, cross-section and is provided with a shallow recess on the upper surface. A separate outer glass stop 90 is interlocked along the outer edge of the recess to form the outside wall of the glazing channel for the existing glazing panels 20. A spacer element 40A generally similar to the element 40 previously described, is utilized and includes a hook shaped lip 41 for interlocking engagement with the inside edge of the recess in the upper surface of the transom bar 24.

Referring to FIG. 6, a modified transom bar 24B is provided and this transom bar permits a door 22B to open or swing both ways. The general construction of the wall section above the transom is similar to that shown in FIG. 5 and a modified spacer element 40B similar to the element 40A is utilized and interlocked with the recess on the upper surface of the transom bar 24B by the hook edged slip 41 as shown.

Referring to FIG. 7, therein is shown a modified form of vertical mullion 12C having integrally formed fins 13 extending outwardly from opposite jamb surfaces thereof. The fins 13 provide the inside walls of a glazing pocket 26C which is filled with glazing compound around the outer peripheral edge of the pre-existing outer glazing panels 20. A separate outside glazing stop 92 is provided to form the outside wall of the glazing pocket for the panels 20 and screw fasteners 94 are provided to secure the glazing stop in place on the frame members.

In accordance with the invention, a modified form of spacer element 40C is provided having a generally rectangular, tubular, hollow body portion containing desiccant material 54 and openings 56 in the wall 58 thereof communicating with the dead air space 36 between the outer pre-existing glazing panels 20 and the inside, secondary panels 34 installed in accordance with the present invention. Glazing material 52 is provided around the outer edge of the integral fins 13 to seal between the fins, the spacer elements 40C and the inside surface of the outer glazing panels 20. Adhesive tapes 62 having adhesive material on opposite sides are provided to temporarily hold the outer surface of the inside, secondary glazing panels 34 and the adjacent wall surfaces of the spacer elements 40C and a bead of extruded adhesive material 64 is provided to secure the peripheral edges of the inside, secondary glazing panels 34 in place and effect an air tight seal as previously described.

Figure 8:
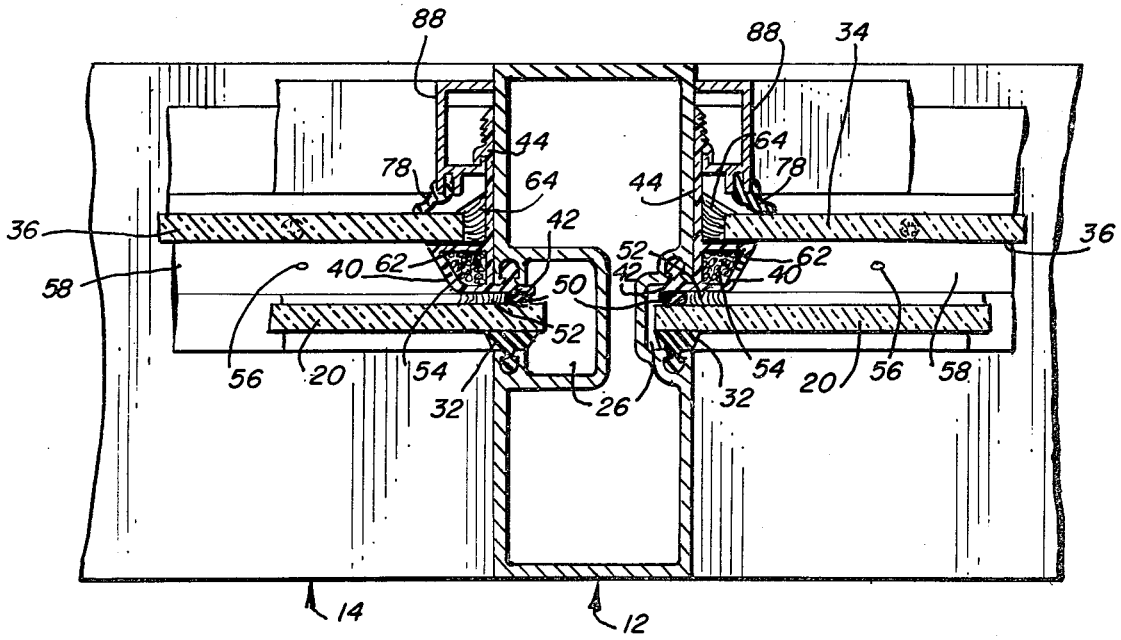
FIG. 8 is a fragmentary horizontal cross-sectional view similar to FIG. 7 but illustrating another embodiment of the present invention.

Referring to FIG. 8, the mullion 12 is identical to that shown in FIG. 3, but instead of a U-shaped cover element 72 as previously described, the inside portion of the mullion is left uncovered and a pair of separate glazing strips 88 of the type used above the transom bars 24 or 24B and depicted in FIG. 4, are provided to cover the marginal edge portions of the inside, secondary glazing panels 34 after installation.

Figure 10:
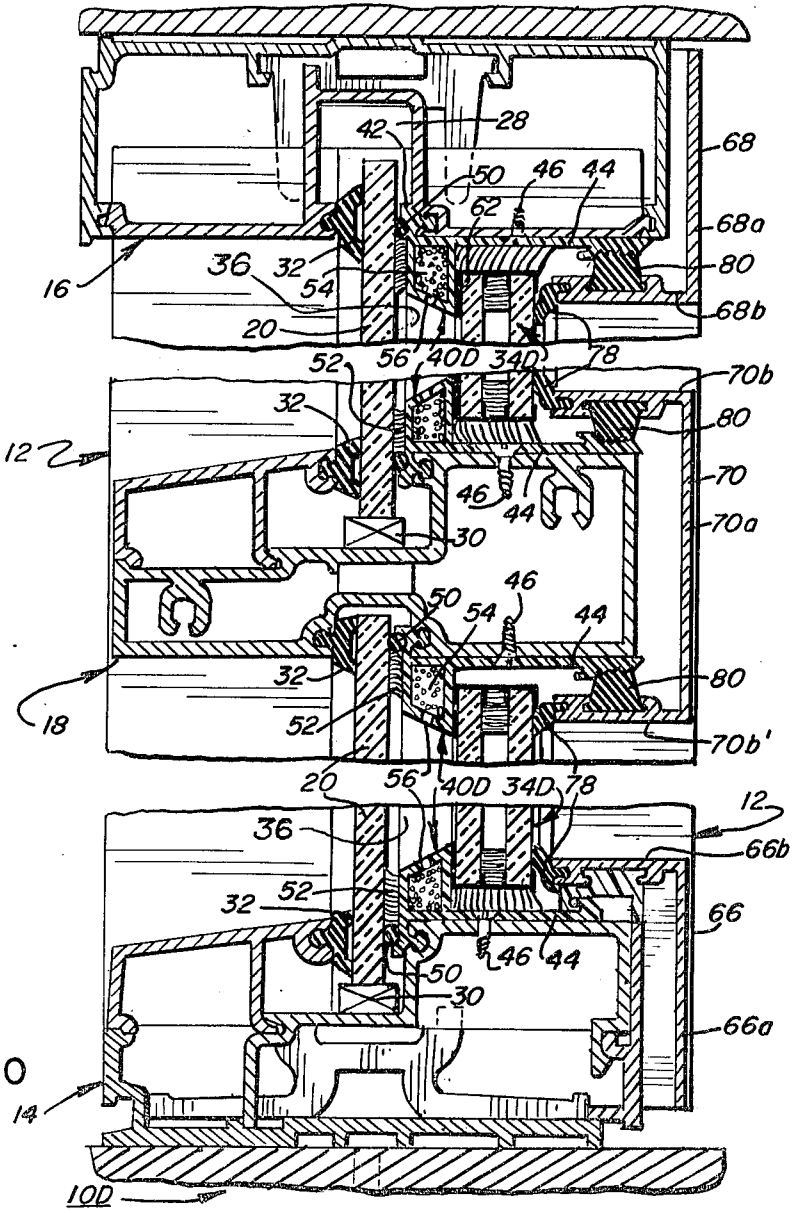
FIG. 10 is a vertical cross-sectional view similar to FIG. 2 illustrating another embodiment of the invention wherein new dual glazing panels are provided to improve the heat insulating characteristics of an existing single glazed wall system.

Referring now to FIG. 10, therein is illustrated another embodiment of the present invention wherein an existing single glazed wall system 10D is provided with additional inside dual glazing panels 34D thus forming a wall having greatly improved heat insulating characteristics. The wall system 10D is generally similar to that shown in FIG. 2, except that the inside glazing panels 34D are of dual thickness employing two panes of glass instead of single thickness glazing panels. Spacer elements 40D are mounted between the panels 20 and the inside panels 34D and are generally similar to the spacer elements 40 previously described except that flange portions 44 thereof are of a suitable width in order to accommodate the greater thickness of the dual secondary glazing panels 34D.

Figure 11:
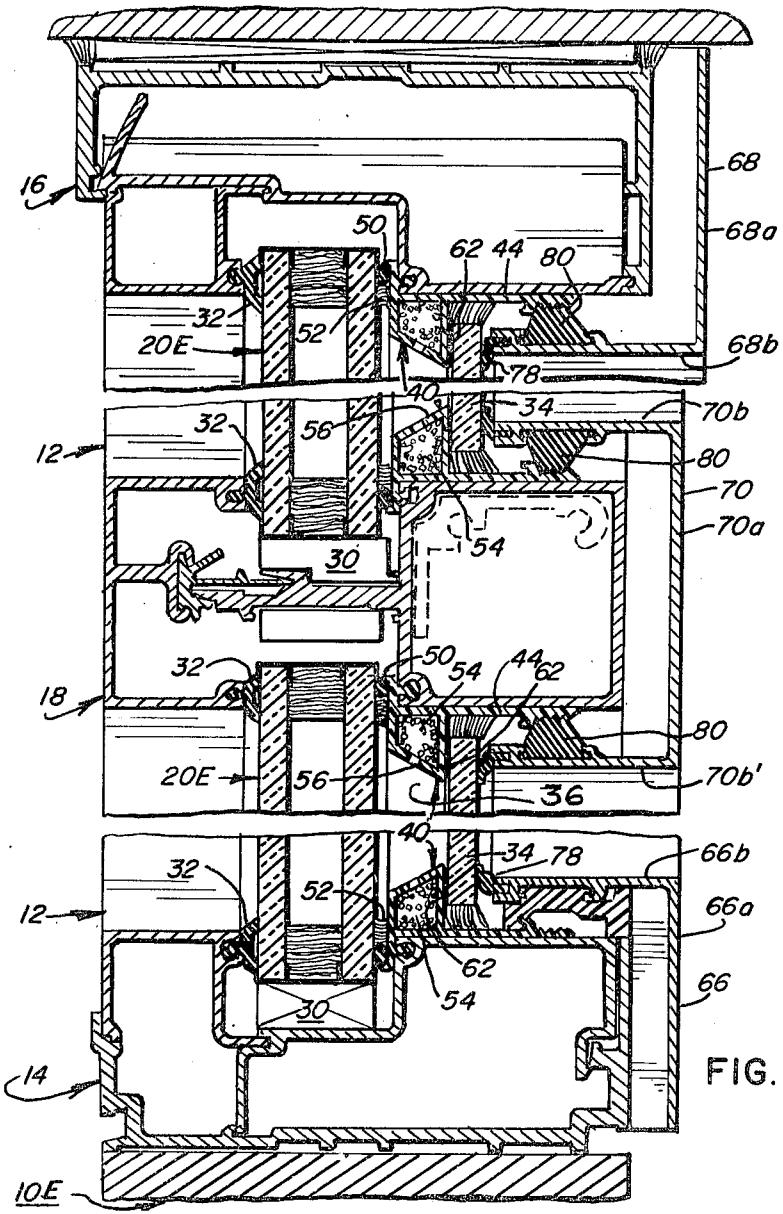
FIG. 11 is a vertical cross-sectional view similar to FIG. 2 illustrating yet another embodiment of the present invention wherein additional new glazing panels are provided to improve the heat insulation characteristics of an existing dual glazed wall system.

Referring now to FIG. 11, therein is illustrated yet another embodiment of the present invention wherein an existing dual glazed wall system 10E which employs a plurality of THERMOPANE or TWINDOW dual glazed panels 20E is provided with additional inside glazing panels 34 spaced adjacent the inside faces of the existing dual glazing panels to provide triple glazing. The spacer elements 40 are similar to those previously described and utilized for spacing and support of the additional secondary glazing panels 34. As with prior embodiments the inside frame portions of the building structure are provided with covers 66, 68 and 70 as illustrated to enclose and beautify the modified triple glazed system.

Figure 12:
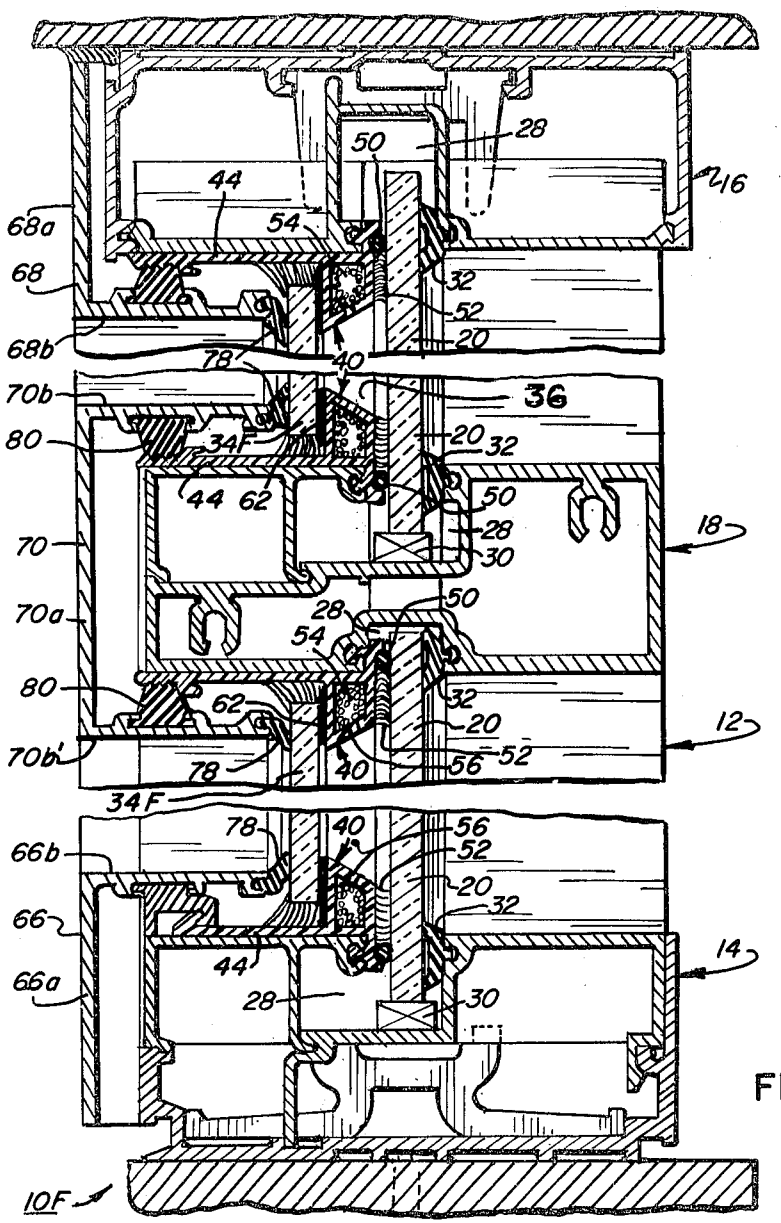
FIG. 12 is a vertical cross-sectional view similar to FIG. 2 illustrating still another embodiment of the present invention wherein additional glazing panels are provided adjacent the outside surface of an existing glazing panel wall system to improve the heat insulating characteristics thereof.

Referring to FIG. 12, therein is illustrated still another embodiment of the present invention wherein an existing single glazed wall structure 10F is modified by the addition of outer glazing panels 34E installed in parallel with the inner existing panels. The additional secondary panels are spaced outwardly of the panels 20 and spacer elements 40 containing the desiccant material 54 are provided as previously described. In general, the wall system shown in FIG. 12 is similar to those previously described except for the fact that the additional secondary glazing panels 34F are mounted adjacent the outer side of the pre-existing panels 20D rather than inside. In addition, mullion and horizontal member cover elements such as those illustrated as 66, 68 and 70 are provided to enclose the outer surfaces of the existing framework to insulate and beautify the appearance of the structural after the secondary glazing panels are in place.

Figure 13:
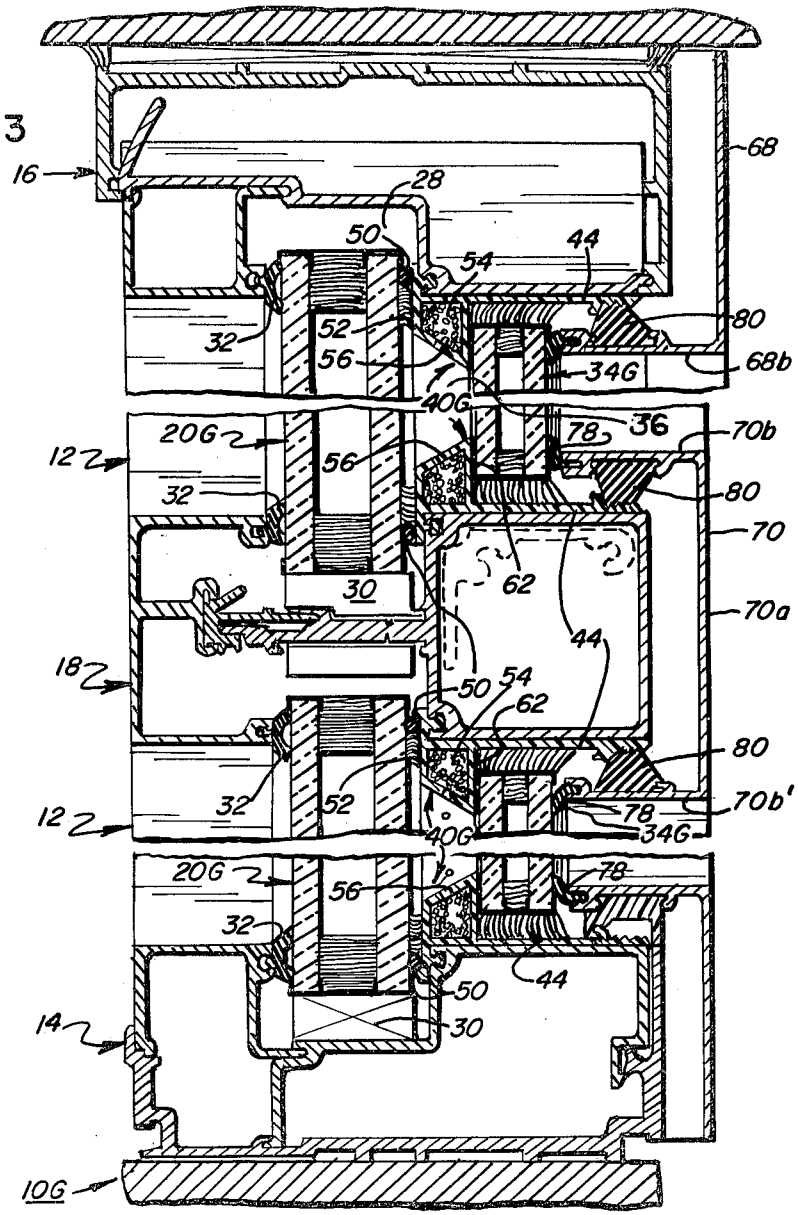
FIG. 13 is a vertical cross-sectional view similar to FIG. 2 illustrating yet another embodiment of the present invention wherein additional dual glazing panels are provided to improve the heat insulating characteristics of an existing dual glazed wall system.

In FIG. 13 is illustrated yet another embodiment of the present invention wherein an existing wall structure 10G having a plurality of dual glazed panels 20G is modified in accordance with the present invention by the installation of spacer elements 40G which are similar to the spacer elements 40D in order to provide spacing for additional dual glazed inside glazing panels 34G mounted in parallel with the preexisting panels 20G. The modified wall structure 10G as illustrated, thus provides a quadruple glazed structure having extremely good heat insulating characteristics. As with all embodiments a sealed dead air space is formed between the existing glazing panels and the secondary glazing panels.

From the foregoing it will be seen that the new and improved double glazed wall system of the present invention provides an economical means for improving the heat insulating characteristics on existing building structures which have a large area of glass in the walls. The secondary, inside glazing panels 34 may be installed with a minimum of disruption of normal operations in the building and do not require the removal or opening of the building to weather during the installation process. In addition to providing better heat insulating characteristics over the glass surfaces, the system also provides for improved heat insulating characteristics for the framework supporting the glazing panels. The entire conversion process to a double glazed wall is accomplished with a minimal reduction in visibility or glass area and without adding great bulkiness or unappealing structural elements onto the existing frame system. A positive seal is provided between the existing and secondary glazing panels so that a dead air space is provided which further improves the heat insulating characteristics. The novel spacer elements provide a convenient housing for desiccant material which insures that moisture is absorbed and does not condense on the closely facing surfaces of the parallel spaced glazing panels.

With increasing energy costs, the present invention provides a means for economically converting buildings having large areas of glass in a single glazed wall into double glazed wall structures. The conversion can be accomplished rapidly and without requiring any external scaffolding since the secondary glazing panels and associated elements are all installed from inside the building.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. Apparatus for converting into a double glazed wall structure an existing single glazed wall structure of the type having a single thickness first glazing panel with a peripheral edge portion seated and supported in a glazing pocket of at least one frame member, said apparatus comprising:

a spacer element supportable from said frame member on one side of said first glazing panel and having a stop surface parallel thereof facing a parallel surface of an edge portion of a new second glazing panel disposed in spaced apart parallel relation from said first panel forming a dead air space therebetween, said spacer element comprising an elongated hollow tubular member having a pair of spaced apart side walls facing said first and second glazing panels, a first wall extending transversely between said first and second side walls and having openings therein for communication between the interior of said tubular member and said space, and a second transversely extending wall spaced from said first mentioned transversely extending wall and adjacent a facing surface of said frame member, a tongue adjacent said one side of said first glazing panel extending inwardly of said second transversely extending wall into said glazing pocket of said frame member interlocked between a wall of said pocket and an adjacent surface of said first glazing panel, desiccant material in communication with said space defined between said first and second glazing panels, and means for supporting an edge portion of said second glazing panel in place adjacent said spacing element.

2. The apparatus of claim 1 wherein said spacer element includes a cavity for containing said desiccant material in communication with said space.

3. The apparatus of claim 2 wherein said spacer element comprises an elongated hollow member having a wall generally transverse to said glazing panels including openings therein providing communication between said cavity and said space.

4. The apparatus of clain 1 including sealing means between said first glazing panel and said tongue.

5. The apparatus of claim 1 including sealing means between said glazing panel and said spacer element.

6. The apparatus of claim 1 including means for securing said spacer element with a surface of said second glazing panel facing said first glazing panel.

7. The apparatus of claim 6 wherein said securing means comprises adhesive material.

8. The apparatus of claim 6 wherein said securing means comprises adhesive tape.

9. The apparatus of claim 8 wherein said adhesive tape includes adhesive material on opposite sides for attachment to said spacer element and said second glazing panel.

10. The apparatus of claim 5 including second sealing means between said spacer element and said second glazing panel.

11. The apparatus of claim 1 including means for sealing said spacer element between said first and second glazing panels.

12. The apparatus of claim 11 wherein said spacer element is secured to said frame.

13. The apparatus of claim 1 wherein said last mentioned means comprises sealing means between said spacer element and said second glazing panel.

14. The apparatus of claim 1 wherein said last mentioned means comprises sealing means between said frame and said second glazing panel.

15. The apparatus of claim 1 wherein said spacer element includes a wall portion overlying a portion of said frame adjacent said second glazing panel and adapted to be secured to said frame with fastener means.

16. The apparatus of claim 1 including a cover element supported from said frame member for covering said edge portion of said second glazing panel.

17. The apparatus of claim 16 wherein said cover element covers at least a portion of said frame member.

18. The apparatus of claim 16 including insulation means between said cover element and said frame member.

19. The apparatus of claim 16 including insulation means between said cover element and said second glazing panel.

20. The apparatus of claim 18 wherein said insulation means extends between said cover element and said spacer element.

21. The apparatus of claim 16 including means for interlocking said cover element and said spacer.

22. The apparatus of claim 21 wherein said interlocking means includes insulation means between said spacer element and said cover element.

23. The apparatus of claim 16 wherein said frame member includes a pair of opposite wall portions generally normal to said glazing panels, and including means for interlocking said cover element with said opposite wall portions to enclose a portion of said frame member.

24. The apparatus of claim 23 wherein said frame member includes a third wall parallel and spaced from said glazing panels and extending between said opposite wall portions thereof, and said cover element includes walls parallel and spaced outwardly of said opposite wall portions and third wall of said frame member enclosing the same.

25. The apparatus of claim 23 including insulating means interconnecting parallel walls of said cover element with said opposite wall portions.

26. The apparatus of claim 25 wherein said interlocking means includes said insulating means and a wall portion of said spacer element positioned adjacent at least one of said wall portions of said frame member.

27. The apparatus of claim 16 wherein said cover element covers at least a portion of said last mentioned means.

28. The apparatus of claim 16 including a flexible closure member between said cover element and said second glazing panel.

29. A method of insulating a building wall structure of the type having a first glazing panel with an edge portion thereof supported in a pocket of a wall frame member, said method comprising the steps of:

removing any existing seal between said first glazing panel and said pocket of said wall frame before installation of a spacer element, interlocking a tongue of said spacer element between said first glazing panel and said pocket of said wall frame where said existing seal was removed, attaching said spacer element on one side of said first glazing panel adjacent said pocket of said wall frame member, installing a second glazing panel in said wall structure parallel and spaced from one side of said first glazing panel adjacent said spacer element, and forming a seal between said first and second glazing panel adjacent said frame member whereby a sealed air space is provided between said parallel first and second glazing panels.

30. The method of claim 29 wherein said seal between said first and second glazing panels is formed by the steps of:

forming a first seal between said first glazing panel and said spacer element, and forming a second seal between said second glazing panel and said spacer element.

31. The method of claim 29 including the step of:

covering a marginal edge potion of said second glazing panel adjacent said frame member.

32. The method of claim 31 including the step of:

covering at least a portion of said wall frame member adjacent said second glazing panel.

33. The method of claim 29 wherein said covering step includes installing a cover element in position adjacent said frame member in covering relation with said marginal edge portion of said second glazing panel.

34. The method of claim 33 including the step of:

insulating between said cover element and said frame member.

35. The method of claim 33 including the step of closing off at least a portion of a space between said cover element and said second glazing panel.

36. The method of claim 29 including the step of:

placing a desiccant material in communication with said sealed air space between said first and second glazing panels.

37. The method of claim 26 including the step of:

covering a marginal edge portion of said second glazing panel adjacent said frame member with a cover element.

38. The method of claim 37 including the step of:

insulating between said cover element and said frame member adjacent said second glazing panel.

* * * * *